US012390681B2

(12) United States Patent
Brittle

(10) Patent No.: US 12,390,681 B2
(45) Date of Patent: Aug. 19, 2025

(54) BASE FOR A MODULAR EXERCISE SYSTEM

(71) Applicant: CB Sailing Limited, Portsmouth (GB)

(72) Inventor: Chris Brittle, Portsmouth (GB)

(73) Assignee: CB Sailing Limited, Portsmouth (GB)

( * ) Notice: Subject to any disclaimer, the term of this patent is extended or adjusted under 35 U.S.C. 154(b) by 110 days.

(21) Appl. No.: 18/391,232

(22) Filed: Dec. 20, 2023

(65) Prior Publication Data

US 2024/0245950 A1 Jul. 25, 2024

(30) Foreign Application Priority Data

Jan. 20, 2023 (GB) ..... 2300862

(51) Int. Cl.
*A63B 21/00* (2006.01)
*A63B 24/00* (2006.01)

(52) U.S. Cl.
CPC .... *A63B 21/4033* (2015.10); *A63B 21/00058* (2013.01); *A63B 24/0062* (2013.01); *A63B 2220/833* (2013.01); *A63B 2225/093* (2013.01)

(58) Field of Classification Search
CPC ..... A63B 21/4033; A63B 21/00058; A63B 24/0062; A63B 2220/833; A63B 2225/093; A63B 2024/0093; A63B 2071/065; A63B 21/005; A63B 71/0622; A63B 69/14; A63B 2069/165; A63B 2071/025; A63B 2071/026; A63B 2071/0683; A63B 2209/08; A63B 2210/50; A63B 24/0087; A63B 2220/51; A63B 2220/62; A63B 2225/15; A63B 2225/50; A63B 2225/685; A63B 2230/755; A63B 22/0046; A63B 22/06
See application file for complete search history.

(56) References Cited

U.S. PATENT DOCUMENTS

| | | | | |
|---|---|---|---|---|
| 5,409,435 | A | 4/1995 | Daniels | |
| 2006/0073944 | A1 | 4/2006 | Zuckerman | |
| 2022/0040535 | A1 | 2/2022 | Warren | |
| 2024/0165482 | A1* | 5/2024 | Bowden-Eyre ..... | A63B 21/078 |
| 2024/0189651 | A1* | 6/2024 | Drayer ..... | A63B 23/03516 |

FOREIGN PATENT DOCUMENTS

| | | | |
|---|---|---|---|
| EP | 2801394 | A1 | 11/2014 |
| GB | 2324479 | A | 10/1998 |

OTHER PUBLICATIONS

"GB Search Report under Section 17" in GB2300862.6, dated Jul. 6, 2023.
"GB Search Report under Section 17" in GB2300862.6, dated Jul. 5, 2023.

* cited by examiner

*Primary Examiner* — Sundhara M Ganesan
(74) *Attorney, Agent, or Firm* — William H. Bollman

(57) ABSTRACT

The present invention relates to a base for a modular exercise system comprising: a ground element for locating the base on a surface; a resistance apparatus mounted on the ground element; an attachment means for receiving and connecting an interchangeable exercise device to the base; and at least one first sensor which is operative to detect and identify the interchangeable exercise device when connected to the base and to communicate with a processor when the resistance apparatus is engaged with a drive mechanism on the interchangeable exercise device.

21 Claims, 10 Drawing Sheets

Side view

Rear view

Section B-B (1:4)

Plan view

Side view
A
22
23
14
40
21
14
10
12
A

Section A-A (1:5)
30
33
41
22
22A
31
42
32
24
24
13
40
10
12

Rear view
41
42
24
10
40
12

33
22A
22
30
23
24
42
12
21
10
14
13

Plan view
30
41
42
24
13
10

Front view

Side view

Section B-B (1:2)

Section A-A (1:2)

Rear view

Side view

Plan view

300

BASE FOR A MODULAR EXERCISE SYSTEM

FIELD OF THE INVENTION

The present invention relates to a base for a modular exercise system, in particular a base with a resistance apparatus that can receive different types of exercise devices that each engage with the resistance apparatus when connected.

BACKGROUND

When training for a particular sport or activity it is often necessary to perform exercises that targets different muscle groups. Typically this may involve use of multiple exercise devices which take up considerable space and therefore it may not be easy or possible to train and store the equipment at home and instead equipment may be provided at a gym or training centre.

Additionally, when training on different equipment it is often necessary to change the parameters measured or the training goals to be achieved on a particular device so that training data can be analysed, or training zones set. Usually a user will manually select training settings from a menu for each device they use to reflect the training device. This can take time which reduces training time and may make it harder to compare activities.

The present invention overcomes these problems.

PRIOR ART

Smart turbo trainers provide a base with a resistance means that is adapted to receive a bicycle and simulate cycling in an indoors environment. The smart turbo trainer can link with software on an electronic device.

SUMMARY OF THE INVENTION

According to a first aspect of the present invention there is provided a base for a modular exercise system comprising: a ground element for locating the base on a surface; a resistance apparatus mounted on the base; an attachment means for receiving and connecting interchangeable exercise devices to the base; and at least one sensor which is operative to detect and identify the interchangeable exercise device, when connected to the base, and is operative to communicate with a processor when the resistance apparatus is engaged with a drive mechanism on the interchangeable exercise device.

In this way the same base can be used with a number of different exercise devices to perform different exercises without the requirement for multiple different standalone exercise devices; and without the requirement to manually configure resistance settings for different devices, since the type of exercise device attached is identified and settings can be automatically activated for the particular exercise device. Advantageous training can commence immediately once the exercise device is connected with the corresponding resistance profile automatically selected.

Engagement between the resistance apparatus and the drive mechanism includes the physical engagement created by connection of the exercise device to the base which may trigger communication with the processor. For example once the exercise device is connected and has been identified by means of the sensor a signal may be transmitted to the processor from the sensor to confirm engagement.

Engagement between the resistance apparatus and the drive mechanism may also include the act of driving the drive mechanism by the user, the act of which may trigger communication with the processor, by means of transmission of a signal from the sensor to the processor to confirm active use, and/or receipt of a signal to the sensor from the processor. For example the sensor on the base, or a second sensor may detect force applied to through the resistance apparatus and transmit a signal to the processor when force is applied.

The base has at least one sensor which is operative to detect and identify the selected interchangeable exercise device when connected to the base. The at least one sensor may be mounted on or within the base. Therefore in some embodiments the one or more sensor is not visible.

For example each exercise device may include a microchip with identification details so that the sensor on the base detects the microchip and obtains data pertaining to the identification of the exercise device. For example the base may include a sensor in the form of a Radio Frequency Identification (RFID) reader that communicates with a passive RFID tag (microchip) on the exercise device.

Data obtained from at least one sensor is relayed to the processor. The processor provides a central hub with a receiver for receiving data that is analysed by the processor and a transmitter to send command signals, for example to the resistance apparatus to change resistance.

The processor may be mounted on the base, or may be provided on the exercise device, or may be remote. Typically the processor is part of an electronic device that includes a display screen for displaying information relating to the signals received form the at least one sensor.

An electronic device has a power source such as a battery or receives a power source, such as from a power supply.

In a preferred embodiment the processor is provided as part of an electronic device with a screen (display) that is arranged on the exercise device where it can be viewed by a user during exercise. The electronic device may be integrated with the exercise device or may be a separate module that can be moved from one exercise device to another.

In another embodiment the processor may be provided on the base and may transmit signals to an electronic device with a display screen that can be viewed by a user whilst exercising. In this example the processor may communicate with the electronic device wirelessly or by a wired connection.

In a preferred embodiment the processor is associated with a control means that enables a user to manually select resistance settings (increasing or decreasing resistance on the resistance apparatus). For example the processor and control means may be combined on an electronic device that is integrated with the exercise device, or remote electronic devices such as a smart phone or tablet. In this way the electronic device can both analyse sensor signals by means of the processor and be used to control the resistance apparatus.

It is appreciated that in some embodiments the processor and control means may be provided as separate elements that communicate.

Ideally the control means is arranged at a location close to a user's hands when exercising so that they can easily select the chosen resistance.

The at least one sensor is also adapted to communicate with the processor, or a second sensor is provided to communicate with the processor, when the resistance apparatus is engaged with a drive mechanism on the interchangeable exercise device. This enables resistance data to be obtained by the one or more sensor when the exercise device is being driven by a user.

Preferably the at least one sensor or a second sensor is operative to transmit a signal to a receiver in communication with the processor confirming when the resistance apparatus is being driven by the drive mechanism on the interchangeable exercise device.

In this way when the exercise device is in use and being driven and the resistance apparatus is engaged, or when the exercise device is not in use, this is automatically detected by at least one sensor and a signal is transmitted to the processor so that status is determined. For example the transmitted signal may indicate when the exercise device is active (driven), inactive (not driven), active under load (driven with resistance over a certain level). This enables periods of activity to be accurately measured.

It is appreciated that an array of sensors may be provided on the base and on each exercise device that all feed sensor data to the processor to assist in providing information relating to resistance settings on the resistance apparatus (such as level of resistance) and data related to the drive mechanism, such as revolutions of a pedal. The sensor data obtained from the array of sensors can be combined to determine user output information. Additional data from a user may also be transmitted to the processor, such as heartrate readings from a heartrate monitor to further assist with exercise analysis.

The processor receives signals detected by one or more sensor by means of at least one receiver that is operatively connected to the processor. In this way the processor receives signals to identify connection of an interchangeable exercise device; identify the type of exercise device; detect when the drive mechanism on the exercise device is in use or not in use. In this way the type of exercise to be carried out is known once assembly on the exercise device on the base is complete so that resistance settings suitable for the type of exercise device are automatically provided, or automatically pre-selected so that no manual input is required to change resistance setting range.

Furthermore, as soon as an exercise device is mounted on the base, suitable training programs may be made available and data collected during exercise can be analysed under parameters set for the specific exercise device so that related data metrics can be collected, recorded and/or displayed without requirement for manual input.

Additionally, if a user is following a particular program that requires certain parameters to be met, such as to maintain a certain number of revolutions per minute, or maintain a perceived effort based on force applied through the drive mechanism, the resistance apparatus may automatically adjust upon receipt of a command signal from the processor under certain conditions to help a user to achieve this.

Preferably the processor may be a microprocessor. The term processor is considered to cover any type of processor suitable for use as part of the system.

Preferably at least one sensor is provided on the base to sense a force applied by the interchangeable exercise device, in particular by the drive mechanism, and the processor derives a signal indicative of an amount of work done.

Preferably at least one force sensor is provided on the resistance apparatus. Advantageously this removes the requirement for separate force sensors on each exercise device, making the exercise system more affordable as the sensors are provided on the base that can be used for all interchangeable exercise devices.

In preferred embodiments at least one transmitter is provided on the base which is operative to transmit a signal from one or more sensor, or each sensor has a transmitter operative to transmit a signal from the sensor to a receiver indicative of at least one of: a force (power) applied by the user; a level of resistance provided by the resistance device; an exercise start time; an exercise end time and total energy expended (kJ or kcal). Measuring these parameters enables exercise exertion feedback to be provided to the user. In some embodiments a sensor may include a transmitter.

In a preferred embodiment the processor is in communication with a display screen so that data collected by the sensors that is transmitted to the processor can be observed whilst using the base and exercise device. For example an electronic device may incorporate the processor, receiver, transmitter, control means and a display screen. The electronic device may be integrated with the exercise device, or the exercise device may include a holder for receiving a displaceable electronic device such as a tablet or smart phone.

It is appreciated that an app maybe provided on an electronic device that is able to receive data and enable display of data and also may be in communication with the resistance apparatus to enable operation of the control means through the app, so that command signals can be sent from the electronic device to the resistance apparatus, for example to alter resistance.

In preferred embodiments, both the base and the interchangeable exercise device may be adapted to be arranged in a first configuration for use, and in a second compact configuration, for stowage to minimise the amount of space required for storage. One way to achieve this is that both the base and interchangeable exercise device preferably have folding parts which may be lockable when deployed.

The ground element is for locating the base on a surface. In preferred embodiments the ground element includes at least three legs to provide a stable ground element that takes up minimal space.

Preferably the legs are foldable so that they can be splayed in use and stowed when not in use to enable easy storage of the base when it is not in use.

In some embodiments the ground element includes feet to enhance grip of the ground element against the surface and to minimise any movement during use. The feet may be formed from or coated in a resiliently deformable material, such as rubber or silicone.

In some embodiments the ground element is adjustable to enable adjustment of height and/or orientation. For example the feet may also be adjustable, or feet may be attached to adjustable legs so that the ground element can be stabilised on an uneven surface.

In some embodiments the feet and/or legs include one or more worm gear to extend and retract, for example by folding the foot and/or leg. In some embodiments the worm gear(s) may be electronically driven, having a motor to drive the gear(s) of the legs/feet may be manually adjustable, such as by a threaded post that engages with the gear(s). In these ways the ground element can be easily setup for use and compacted for storage.

In some embodiments the base may include a level guide, such as a bubble level, or sensors to assist with levelling the base. For example, one or more sensors may be provided to determine when the base is level and the level status may be indicated by one or more visual indicator, such as a light to show when the base is level and unlevel.

The ground element may be weighted so assist with maintaining position of the base during use.

The resistance apparatus is mounted on the ground element. The resistance apparatus is connected to the drive mechanism in use, so that variation of resistance apparatus changes the amount of input force required by the user. The resistance apparatus ideally has an adjustment means for selectively varying its resistance so that a user can make changes during use.

The resistance apparatus preferably has at least one rotating component wherein rotational resistance of at least one component can be altered. For example, the resistance apparatus may include a drive train with at least two drive wheels connected by a belt and a resistance unit, wherein at least one of the drive wheels is connected to the resistance unit so that resistance applied to the drive wheel is adjustable. Advantageously the use of a configuration including drive wheels and a belt provides a quiet, clean, and low maintenance mechanism.

In another embodiment the resistance apparatus may comprise a rotating resistance unit that is adapted to receive a shaft that connects to the drive means and the resistance unit can be adjusted to change ease of rotation.

In preferred embodiments the resistance unit has means to provide magnetic resistance to provide a reliable way to accurately and quickly adjust resistance by altering the strength or orientation of a magnetic field.

Preferably the resistance unit may include electromagnets enabling adjustment using the control means such as a control panel to transmit electronic signals, rather than using a manual dial that may delay changes or limit transitions to the time it takes a user to manually alter the dial. For example the resistance unit may have a resistance coil and magnets to adjust resistance.

In preferred embodiments the control means are provided in use on the interchangeable exercise devices so that a user can adjust resistance easily whilst using the device. The resistance unit is adapted to receive signals and adjust resistance in response to the signals. The control means is in communication with the resistance unit, for example to adjust the electromagnetic resistance. Preferably signals are transmitted wirelessly from the control means to the resistance unit.

The control means enable a user to increase or decrease resistance generated by the resistance apparatus. The control means may have controls such as a selection of buttons, a touch pad, display screen or rocker switch to enable a user to easily toggle between selecting increasing or decreasing resistance. Ideally the control means are ergonomically positioned on the exercise device to optimise the workout by causing minimal effort and change of position to perform adjustment using the control means.

As mentioned above, the control means may part of an electronic device that may be a removeable electronic device, such as a smartphone or tablet.

In a preferred embodiment the control means may comprise or be connected to an electronic device and system (such as an integrated electronic device or an app on a smartphone) that also incorporates the processor to permit a user to adjust resistance, as well as having functions to record and analyse data and to display data so that a user can monitor their progress.

In a preferred embodiment the control means is in communication with, or integrated with a display screen, that may be mounted on the exercise apparatus which can display resistance data. Furthermore as the control means may also be able to receive data by means of at least one receiver, the control means may receive data from other input sources, such as a heartrate monitor so that resistance data can be analysed against user data to provide useful metrics to measure exercise related output.

In some preferred embodiments the resistance unit includes a speedup gearbox that is connected to the resistance unit to increase the rotational speed of the rotating element of the resistance unit.

In some embodiments the base may be adapted to provide user feedback when resistance is changed, or under certain conditions. For example the resistance unit may drop resistance just before a change of resistance is made so that a user receives feedback that a selected change has been initiated. In another embodiment a vibrating module may be provided to provide haptic feedback when a change of resistance is selected or when a preset condition is detected, for example heartrate moves from one training zone to another.

The attachment means is for receiving and connecting an interchangeable exercise device to the base so that different exercise devices can be easily connected and disconnected to the base.

Connection of the exercise device to the base is detected by one or more sensors. Typically this is achieved by an RFID tag on the exercise device being detected by an RFID reader on the base. The RFID reader may only detect an RFID tag within close proximity to establish that it is the exercise device in use and not another exercise device nearby.

In some embodiments the base, or specifically the attachment means, may include a contact sensor to detect presence of the exercise device.

The attachment means extends from the ground element. In some embodiments the attachment means may be combined with parts of the resistance apparatus.

In preferred embodiments an arm extends from the ground element and the arm has at least one figure for receiving the exercise device. For example a pair of fingers may provide a bracket that receives the exercise device.

In a preferred embodiment the attachment means includes a bracket with a means for receiving a pin to enable coaxial connection with the hub of the resistance apparatus (first hub) and a hub on the exercise device (second hub). In this way attachment of the exercise device can simultaneously engage the resistance apparatus and thereby the drive mechanism.

In a preferred embodiment the pin includes at least one spline or ridge that acts to engage both the resistance apparatus and exercise device to that the hub one each rotates in unison by a user driving the drive mechanism.

For example, a toothed pin (pin with splines) may be received through the hub and through a toothed coaxial drive wheel on the resistance apparatus to engage the toothed pin with drive wheel. An inner face of at least part of the hub has a toothed surface and an inner face of at least part of the drive wheel has a toothed surface so that the hub and drive wheel are locked together by the toothed pin and will rotate in unison.

In preferred embodiments distal ends of the splines on the pin may taper to a point to correspond with angled teeth on the first and/or second hubs to enable smooth engagement when inserting the pin. Advantageously this configuration enables insertion of the pin even when the engaging parts are not exactly aligned.

In a preferred embodiment once the pin is in place to connect the base to the exercise device a dog clutch is provided for engaging the hub on the exercise device (second hub) with the resistance apparatus so that when the exercise device is mounted on the base and secured by the attachment means, the hub of the exercise device is selectively engaged with the resistance apparatus when ready for use.

In another preferred embodiment the clutch is a one-way freewheel clutch such as a sprag clutch, preferably a silent sprag clutch. In this way the sprag clutch enables one-way rotation and has a freewheel to permit free rotation when there is no drive generated by a user.

In another embodiment the resistance apparatus has a connector for receiving a driveshaft that is connected to the drive mechanism of the interchangeable exercise device. For example the exercise device may include a bevel box connected to the drive mechanism to enable the driveshaft rotation to be transferred from a first plane to a second plane. In this way the drive mechanism is rotated in a first plane by the user driving the bevel box which causes rotation of the drive shaft in a second plane. Advantageously the use of a bevel box enables power to be distributed through a defined angle, such as 90 degrees which can assist with making the base and exercise device more compact and therefore more easily stored. Furthermore the use of a driveshaft connected to the resistance means provides a quiet, clean, and low maintenance mechanism.

One of the interchangeable exercise devices may be a cycling exercise device with pedals driving a hub that is connected to the resistance apparatus, a seat, and a handlebar in order to simulate a cycling exercise. In this embodiment the control means is located on the handlebar region of the cycling exercise device for ease of use and to reflect where controls are positioned on a bicycle.

Another one of the interchangeable exercise devices may be a grinding exercise device with pedestal handles driving a hub that is connected to the resistance apparatus in order to simulate grinding exercise. For this device the control means may be located on a handle grip region of the grinding exercise device for ease of use during exercise.

Another one of the interchangeable exercise devices may be a rowing exercise device with a retractable handle attached to a line that drives a hub that is connected to resistance apparatus when pulled to simulate rowing. Typically the rowing device also has a sliding seat. The handle may include control means to enable adjustment whilst rowing.

The interchangeable exercise devices may include sensors in communication with the processor or to another remote device that communicates with the processor to provide additional user feedback. For example an exercise device may include accelerometers, gyroscopes and/or laser displacement sensors to provide positional information about the user and/or parts of the devices, for example position of the rowing handle un use, or posture during cycling. This feedback may help to guide a user to enhance their technique, for example by using rower handle position to simulate optimal oar position relative to water.

The exercise devices may also include vibration modules or similar to generate haptic feedback under certain conditions, such as when resistance changes.

Yet further interchangeable exercise devices may include resistance units for weight training.

Preferred embodiments of the invention will now be described, by way of example and with reference to the Figures in which:

DETAILED DESCRIPTION OF FIGURES

Figure 1A:
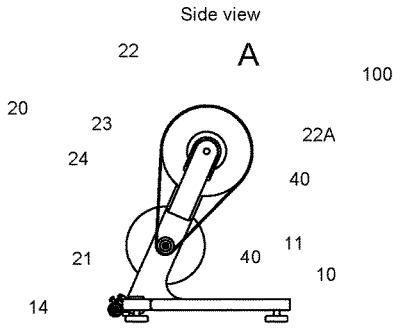
FIG. 1A shows a side view of a first embodiment of the base.
Figure 1B:
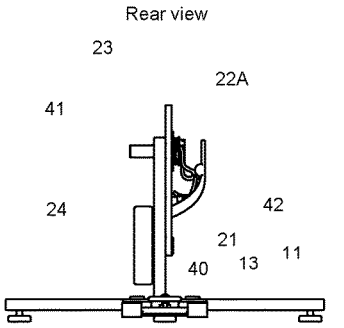
FIG. 1B shows a rear view of the first embodiment of the base.
Figure 1C:
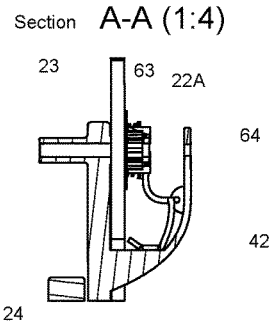
FIG. 1C shows a cross section of the first embodiment of the base.
Figure 1D:
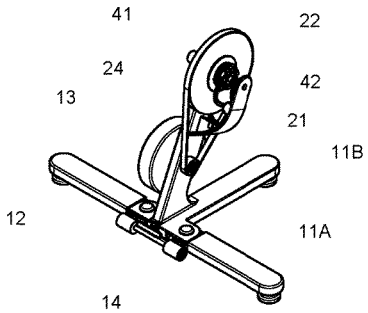
FIG. 1D shows an isometric view of the first embodiment of the base.
Figure 1E:
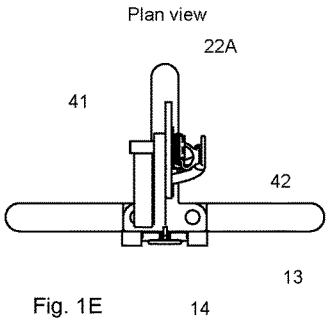
FIG. 1E shows a plan view of the first embodiment of the base.
Figure 1F:
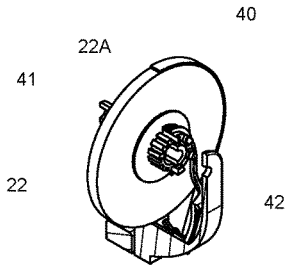
FIG. 1F shows a close up view of the second drive wheel.
Figure 2A:
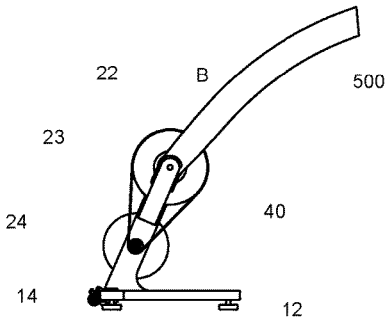
FIG. 2A shows a side view of the first embodiment of the base connected to part of an exercise device.
Figure 2B:
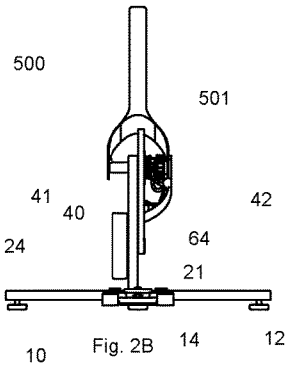
FIG. 2B a rear view of the first embodiment of the base connected to part of an exercise device.
Figure 2C:
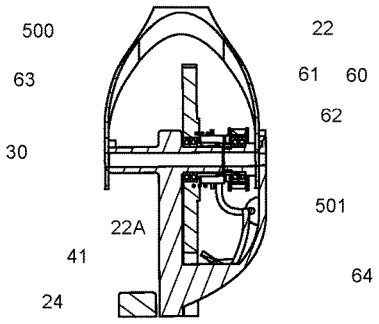
FIG. 2C shows a cross section of part of the first embodiment of the base connected to part of an exercise device.
Figure 2D:
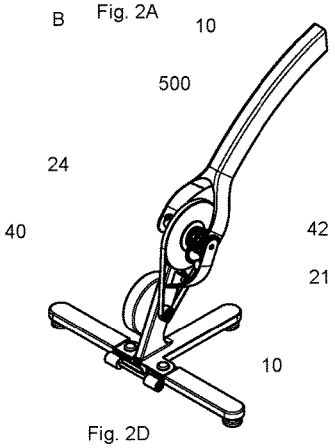
FIG. 2D shows an isometric view of the first embodiment of the base connected to part of an exercise device.
Figure 2E:
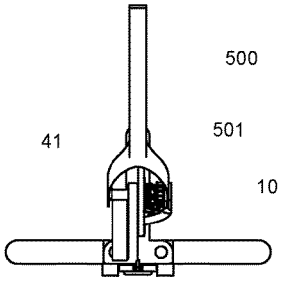
FIG. 2E shows a plan view of the first embodiment of the base connected to part of an exercise device.
Figure 2F:
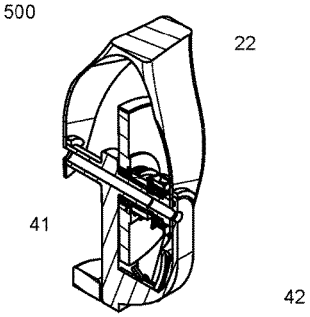
FIG. 2F shows an isometric cross section of part of the first embodiment of the base connected to part of the exercise device.
Figures 3A, 3B, 3C, 3D, 3E:
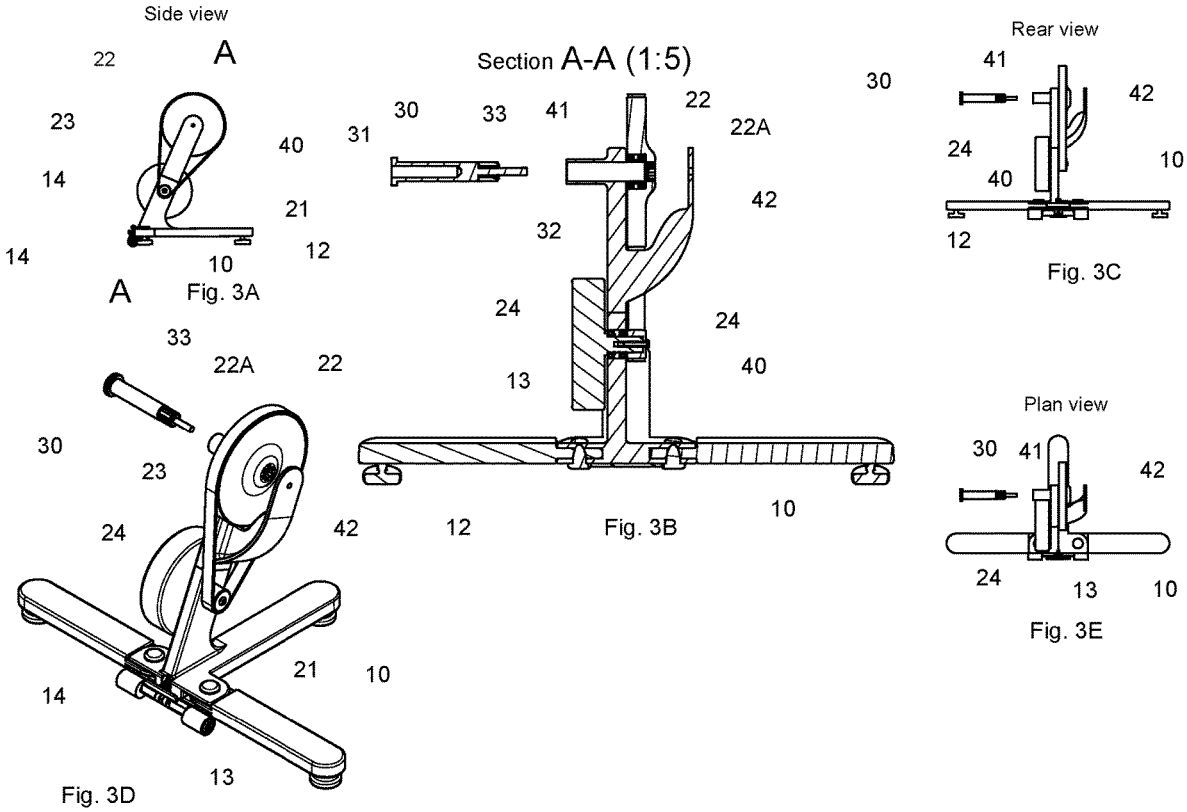
FIG. 3A shows a side view of a second embodiment of the base.
FIG. 3B shows a cross section A-A of the second embodiment of the base.
FIG. 3C shows a rear view of a second embodiment of the base.
FIG. 3D shows a rear isometric view of the second embodiment of the base.
FIG. 3E shows a plan view of the second embodiment of the base.
Figure 4A:
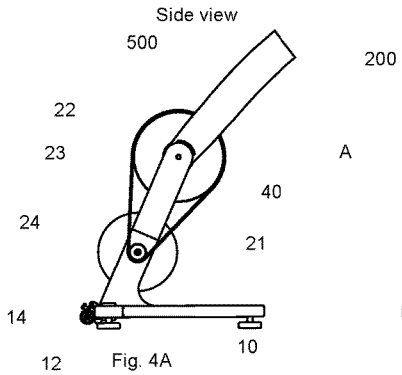
FIG. 4A shows a side view of a second embodiment of the base connected to part of an exercise device.
Figure 4B:
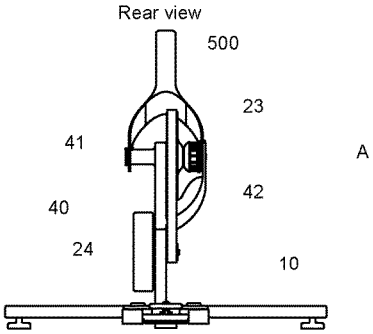
FIG. 4B shows a rear view of a second embodiment of the base connected to part of an exercise device.
Figure 4C:
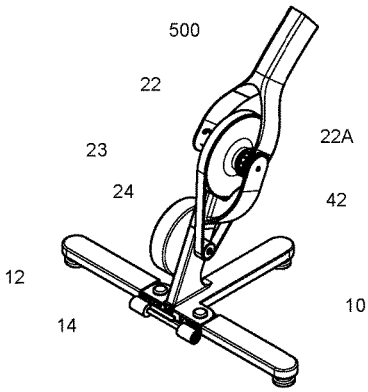
FIG. 4C shows a rear isometric view of the second embodiment of the base connected to a part of an exercise device.
Figure 4D:
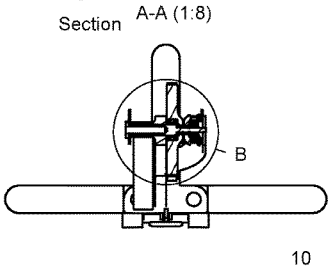
FIG. 4D shows a cross section A-A of the second embodiment of the base.
Figure 4E:
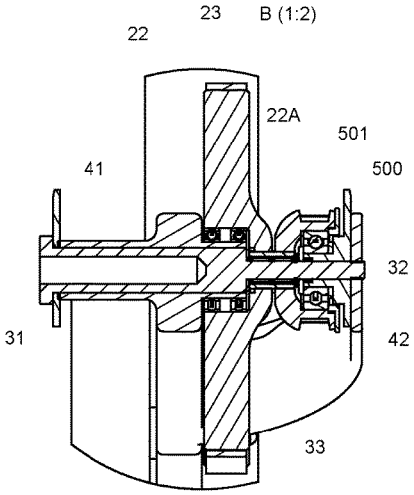
FIG. 4E shows a close up of part of the cross section shown in FIG. 4D.

FIGS. 1A to 1F and 2A to 2F show a first embodiment 100 of the invention with a ground element 10 with three legs 11. Each leg 11 having a foot 12 that spaces the leg from the surface.

The ground element 10 is formed from metal, such as steel, and the feet 11 are adjustable elements to enable the feet 12 to be adjusted to compensate for an uneven surface.

Two of the legs 11A are hinged at pivots 13 to enable the legs 11A to be splayed as shown in the FIGS. 1A, 1B, 1D and 1E or stowed (not shown) wherein the two legs 11A are arranged to fold inwards to be parallel to the third leg 11B.

The ground element 10 has a pair of wheels 14 mounted on an edge to enable the base 100 to be wheeled to assist with movement from one location to another.

The resistance apparatus 20 comprises first and second drive wheels 21, 22 connected by a belt 23 and the first drive wheel 21 is connected to a resistance unit 24. The first drive wheel 21 has adjustable resistance as it is connected to the resistance unit 24. The second drive wheel 22 has a hub 22A through which a pin 30 is received.

The resistance apparatus 20 which is made up of two drive wheels 21, 22, the belt 23 and the resistance unit 24, is arranged on an arm 40 that extends from the ground element 10. The arm 40 provides location points for both drive wheels 21, 22 and for the resistance unit 24.

The first drive wheel 21 and resistance unit 24 are arranged coaxially on a shaft (not visible).

The second drive wheel 22 is arranged on a finger 41 extending from the arm 40 and the second drive wheel 22 is further secured and engaged by inserting of a pin 30 that passes through the first finger 41 engages with a second finger 42 that extends from the arm 40.

The first finger 41 is a tube that is arranged perpendicular to the plane of the arm 40.

The resistance unit 24 includes electromagnetic resistance means to enable electronic adjustment of resistance to alter ease of rotation of the first drive wheel 21 and thereby the second drive wheel 22 that is connected to the drive mechanism on the exercise device 500.

Resistance applied to the first drive wheel 21 can be adjusted by changing the magnetic field created by the electromagnets in the resistance unit 24.

The pin 30 is received through the first finger 41 and a distal end 31 of the pin 30 is connected to the second finger 42 by a screw thread connection (not shown).

The attachment means 50 is provided by the pin 30 and the fingers 41, 42. The first finger 41 is a tubular extension through which the pin 30 is received. The second finger 42 provides a distal end for receiving the exercise device.

The pin 30 enables the exercise device 500 to be connected to the resistance apparatus 20 and the fingers 41, 42 provide a support bracket for receiving and supporting the exercise device during use. In this way the exercise device 500 can be easily arranged on the base 100 and securely connected to the base 100.

When the exercise device 500 is mounted on the base 100 a dog clutch 60 enables engagement of the hub 22A of the second drive wheel 22 with the drive mechanism (not shown in FIGS. 1 and 2) of the exercise device 500.

The dog clutch 60 has two engagement surfaces 61, 62. The first engagement surface is mounted on a spring 63 so that when the spring 63 is released the first engagement surface 61 connects with the second corresponding engagement surface 62 on the exercise device so that the dog clutch 60 is engaged. When the dog clutch 60 is engaged the connected parts on the base and exercise device rotate in unison.

A switch 64 is provided to lock and release the first and second engagement surface 61, 62. When the spring 63 is compressed the first and second engagement surfaces 61, 62 are separated (see FIG. 2C). When the spring 63 is released the first and second engagement surfaces are engaged. The switch 64 is provided on the second finger 42.

The hub 22A of the second drive wheel 22 is coaxial with a hub 501 provided on the exercise device 500, so that both hubs 22A, 501 rotate about the pin 30 and the dog clutch 60 enables engagement surfaces 61, 62 to be engaged so that both parts (drive wheels of resistance apparatus and hub of exercise device that is connected to the drive mechanism) rotate in unison when driven by a user activating the drive mechanism.

FIGS. 3A to 3E and 4A to 4E show a second embodiment of the base 200. In FIGS. 4A to 4E part of an exercise device 500 is shown. Like parts have like references.

The second embodiment 200 has the same arm 40 and fingers 41, 42 configuration, but the exercise device 500 is engaged in a different way.

In the second embodiment 200 the pin 30 is adapted to engage the hub 501 of an exercise device 500 with the second drive wheel 22 of the resistance apparatus 20.

The pin 30 has a distal end 32 that connects to the second finger 42. The pin 30 also has a spline 33 that when inserted through the first tubular finger 41 and located on the second finger 42 positions the spline 33 so that it engages with inner surfaces of the second drive wheel hub 22A and the hub 501 of the exercise device 500 (see FIG. 4E). In this way when the spline 33 is inserted and engaged with both hubs 22A, 501 they rotate in unison so that input from a user through the drive mechanism of the exercise device 500 is in communication with the resistance apparatus 20.

In the pictured embodiments shown in FIGS. 3B to 3E the second drive wheel 22 includes magnets (not shown) to locate the spline 33 into the hub 22A of the second drive wheel 22.

The pin 30 also provides a quick and easy means for connecting the exercise device 500 to the base 200 by forming part of the attachment means 50 that is a combination of the pin 30 and the fingers 41, 42.

FIGS. 5A to 5F show an example of the pin for the second embodiment of the base 200 that enables quick connection.

Figure 5A:
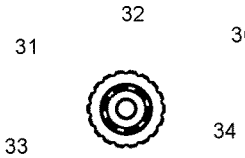
FIG. 5A shows an end view of a pin for use with the second embodiment of the base.
Figure 5B:
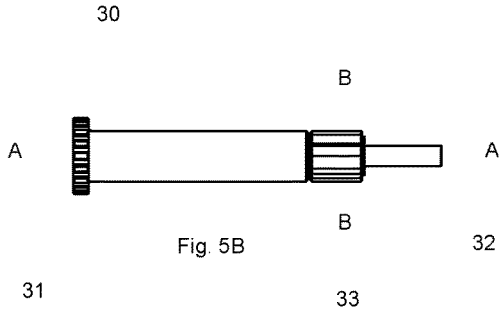
FIG. 5B shows a side view of the pin.
Figure 5C:
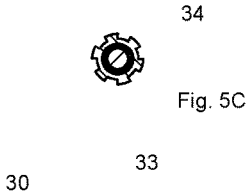
FIG. 5C shows the spline of the pin.
Figure 5D:
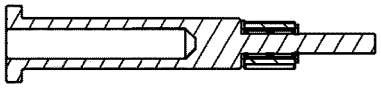
FIG. 5D shows a cross section A-A of the pin.
Figure 5E:
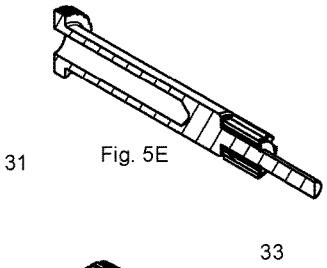
FIG. 5E shows an isometric view of a cross section A-A of the pin.
Figure 5F:
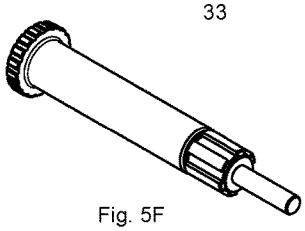
FIG. 5F shows an isometric view of the pin.
Figure 6A:
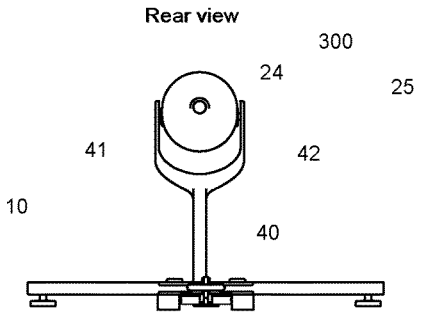
FIG. 6A shows a rear view of a third embodiment of the base.
Figure 6B:
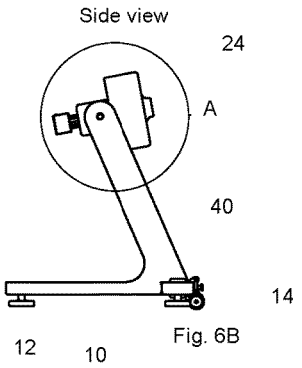
FIG. 6B shows a side view of a third embodiment of the base.
Figure 6C:
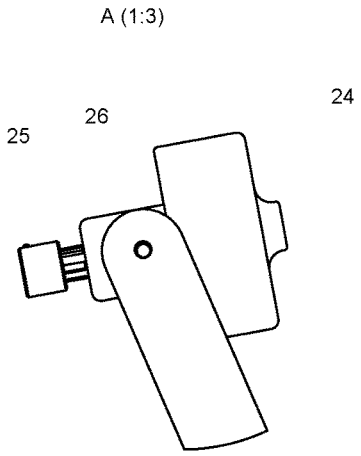
FIG. 6C shows a close up of the resistance unit of a third embodiment of the base.
Figure 6D:
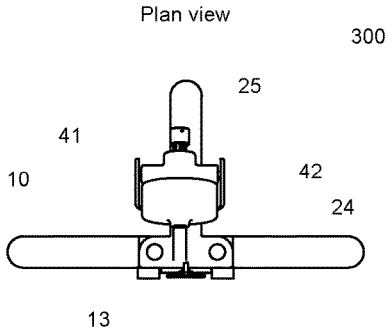
FIG. 6D shows a plan view of a third embodiment of the base.
Figure 6E:
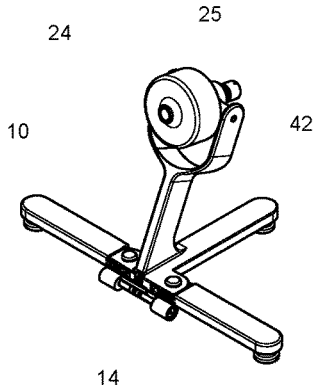
FIG. 6E shows an isometric view of a third embodiment of the base.
Figure 7A:
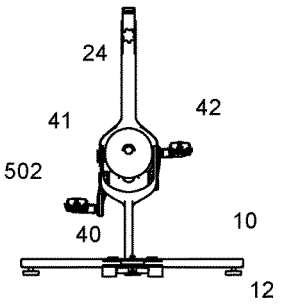
FIG. 7A shows a rear view of a third embodiment of the base connected to part of an exercise device.
Figure 7B:
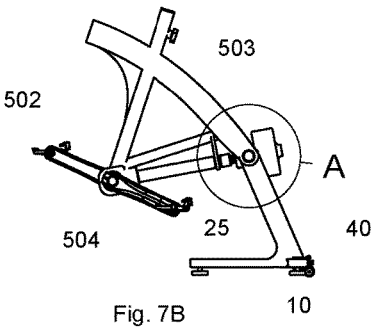
FIG. 7B shows a side view of a third embodiment of the base connected to part of an exercise device.
Figure 7C:
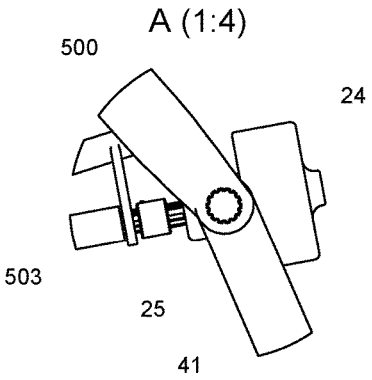
FIG. 7C shows a close up of the resistance unit of a third embodiment of the base connected to part of an exercise device.
Figure 7D:
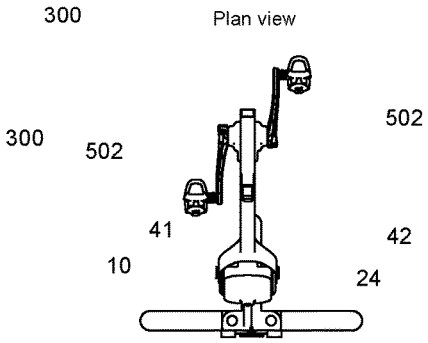
FIG. 7D shows a plan view of a third embodiment of the base connected to part of an exercise device.
Figure 7E:
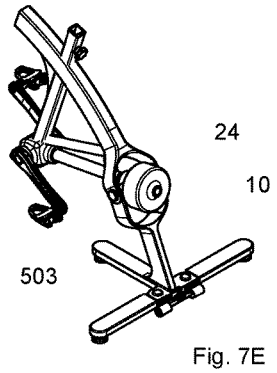
FIG. 7E shows an isometric view of a third embodiment of the base connected to part of an exercise device.

The pin 30 has a spline 33 that rotates freely on needle bearings 34 about the pin 30 so that the main body of the pin does not rotate in use, only the spline 33 (see FIG. 5D). The spline 33 has a toothed outer surface that engages with toothed inner faces of the hub of the second drive wheel 22A and the hub 501 of the exercised device 500. In this way both hubs 22A and 501 rotate in unison and are connected to the resistance apparatus 20 and to the drive mechanism (not shown) of the exercise device.

FIGS. 6A to 6E and 7A to 7E show a third embodiment of the base 300. Like parts have like references. In the pictured embodiment the arm 40 projects from the ground element 10 with a two fingers 41, 42 that both extend upwards in the same configuration. The fingers 41, 42 support a resistance unit 24 that has a connector 25 for receiving a drive shaft 503 provided on the exercise device 500. The exercise device 500 has a bevel box 504 that enables rotary motion generated through the drive mechanism (pedals 502) to be changed through 90 degrees to rotate the drive shaft 503 that is connected to the resistance unit 24.

The fingers 41, 42 also act as a bracket for receiving and supporting the exercise device 500.

The connector 25 is adapted to receive an end of a drive shaft 503 that extends from the drive mechanism 502 of exercise device 500 (see FIGS. 7A, 7B, 7D, 7E). As a user (not shown) drives the drive mechanism 502, by pedalling on the exercise device 500, rotary motion is transmitted by 90 degrees though the bevel box 504 on the exercise device 500 to the driveshaft 503 rotates which enables rotary motion to be transmitted coaxially along the driveshaft by means of the resistance unit 24.

The resistance unit 24 also includes a speed up gearbox 26 that increases rotational speed of the rotating element (not shown) of the resistance unit 24.

The resistance unit 24 has an electromagnetic resistance means to enable a user to quickly and easily adjust resistance.

Figure 8A:
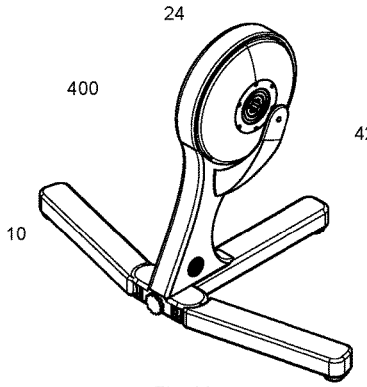
FIG. 8A shows a perspective view of a fourth embodiment of the base.
Figure 8B:
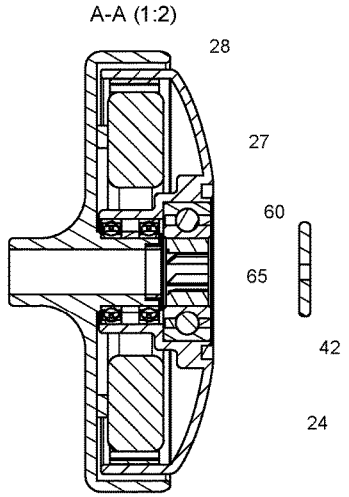
FIGS. 8B and 8C show a cross section of the resistance unit of the fourth embodiment of the base.
Figure 8C:
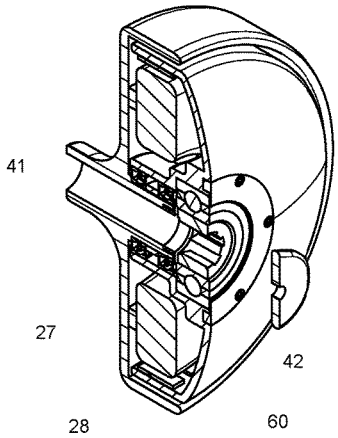
Figure 8D:
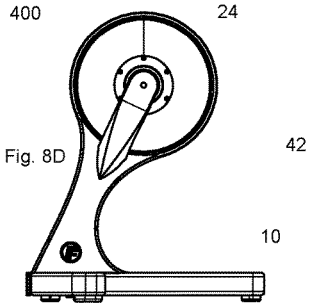
FIG. 8D shows a right side view of the fourth embodiment of the base.
Figure 8E:
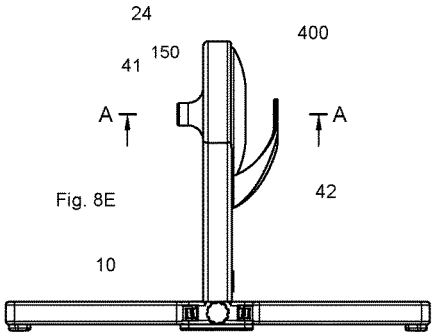
FIG. 8E shows a rear view of the fourth embodiment of the base.
Figure 8F:
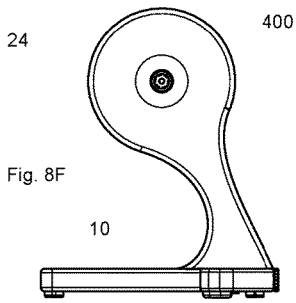
FIG. 8F shows a left side view of the fourth embodiment of the base.
Figure 9A:
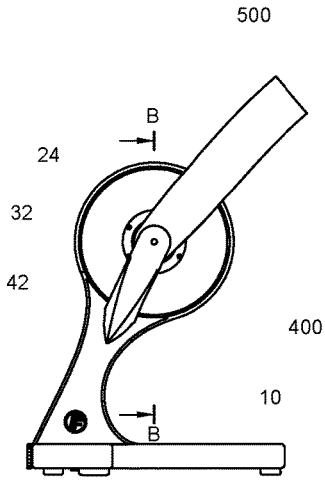
FIG. 9A shows a side view of the fourth embodiment of the base connected to an exercise device that is only part shown.

FIGS. 8 to 9 show a fourth embodiment of the base 400. Like parts have like references.

The fourth embodiment 400 of the base has a one way clutch 60 with angled teeth 65 that receive a pin 30 with corresponding distal ends 35 of the splines 33 of the pin 30 and an exercise device 500 with corresponding angled teeth 505 on the hub 501.

The advantage of the angled teeth 505, 65 that engage with the distal ends 35 of splines 33 is to aid with smooth engagement between the parts even when the teeth may not be directly aligned. The angling of the teeth when used with a one way clutch also means that the coupling between the clutch and pin, the coupling between the clutch and exercise device, are uni-directional and will disengage when rotation is reversed.

Figure 9B:
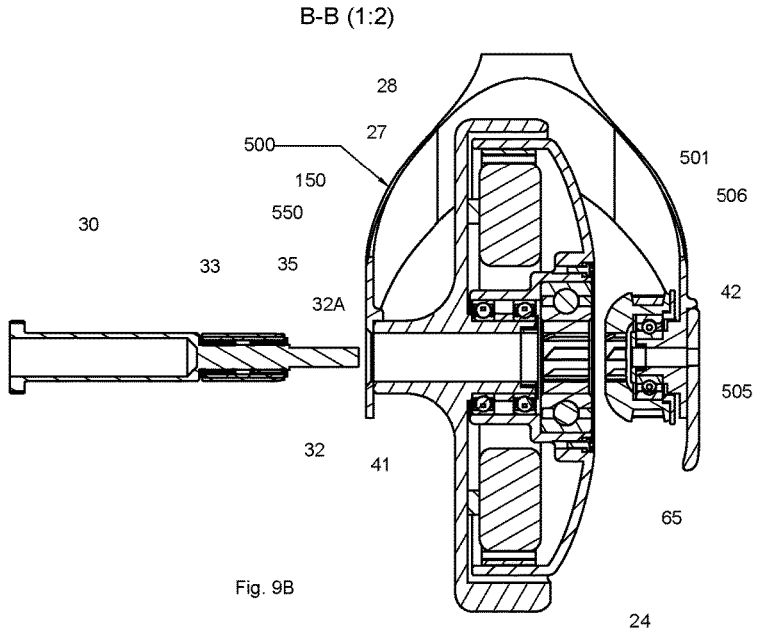
FIG. 9B shows a cross section of FIG. 9A along line B-B.
Figure 9C:
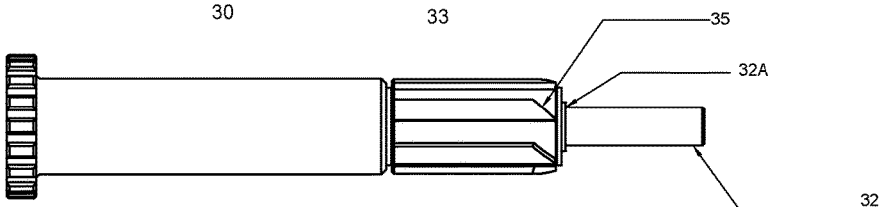
FIG. 9C shows the pin with angled teeth.

On the pin 30 shown in FIGS. 9B and 9C the distal end 32 of the pin 30 has a step 32A. The step 32A engages with the receiving part of the exercise device 500 to correctly secure the base 100, 200, 400 with the exercise device 500. In use the step 32A is pressed against the frame 506 of the exercise device 500 by the engagement of the distal end 32 into the second finger 42. The hub 501 is arranged on the frame 506 so as to rotate in use.

In FIGS. 8E and 9B the position of a sensor 150 on the resistance apparatus 24 is indicated. In FIG. 9B the position of a sensor 550 on the exercise apparatus 500 is shown. The positions shown are only an example of where the sensors may be positioned and the sensors may be located at any suitable position.

FIG. 8E therefore shows an embodiment 400 with all the preferred features of the invention comprising: a ground element 10 for locating the base 400 on a surface; a resistance apparatus 24 mounted on the ground element 10; an attachment means 42 for receiving and connecting an interchangeable exercise device (not shown, refer to FIG. 9B) to the base 400; and a sensor 150 which is operative to detect and identify the interchangeable exercise device when connected to the base 400 and that is also operative to communicate with a processor when the resistance apparatus is engaged with a drive mechanism on the interchangeable exercise device.

Sensor 150 includes an RFID reader arranged on a wall of the resistance apparatus 24. The RFID reader 150 receives signals from an RFID tag 550 provided on each exercise device 500. When the exercise device 500 is mounted on the base (not fully shown in FIG. 9B) a signal transmitted from the RFID tag 550 is detected by the RFID reader 150. Upon identification of the exercise device 500 a resistance profile can be selected for the user.

Sensor 150 is also operative to communicate with the processor when the resistance apparatus is engaged with a drive mechanism on the interchangeable exercise device. Sensor 150 therefore includes means to detect when the resistance apparatus and drive mechanism are engaged which may be achieved for example by detecting resistance created by the resistance apparatus by a force sensor and/or detecting movement when the drive mechanism by a movement sensor. It is therefore appreciated that sensor 150 may combine a plurality of sensing means to detect different parameters.

In FIGS. 8B and 8C there is shown the resistance unit 24 which includes a resistance coil 27 and magnets 28 for generating resistance during rotation. In this embodiment there is no requirement for two drive wheels connected by a belt, instead resistance is generated by the resistance unit 24 that has a hub that receives the pin 30 and has a clutch 60. The base 400 has a first finger 41 and a second finger 42 that provided insertion points for the pin 30. The pin 30 passes through the first tubular finger 41 and the threaded distal end 32 of the pin 30 is connected to a threaded aperture in the second finger 42.

Figure 10A:
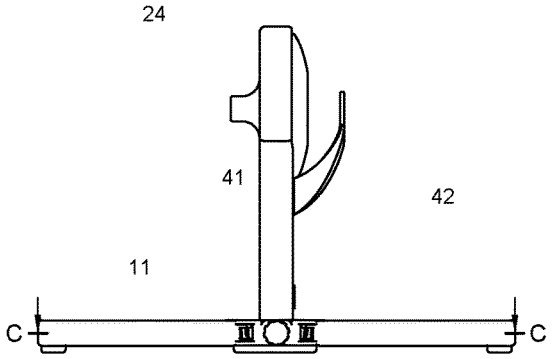
FIGS. 10A and 10B show an example of a folding base.
Figure 10B:
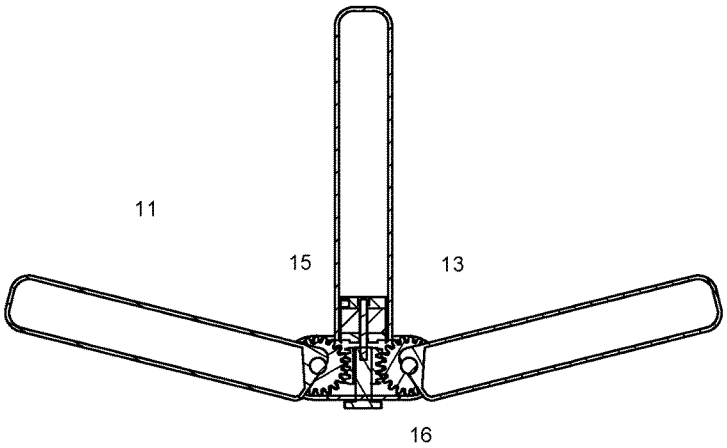

In FIGS. 10A, 10B a mechanism for deploying the legs 11 of the ground element 10 is shown. The legs 11 are pivotable by a pivot formed from worm gears 13. The worm gears 13 are driven by a motor 15 or can be driven manually by a turning a threaded post 16 that is in communication with the worm gears 13. In this way the legs 11 can be folded together for stowage and adjusted to accommodate an uneven surface during use.

In all embodiments 100, 200, 300, 400 at least one sensor 150 (see FIG. 9B that includes an example location) is provided. The at least one sensor may be externally mounted or may be internally mounted, for example inside the arm 40.

Figure 11:
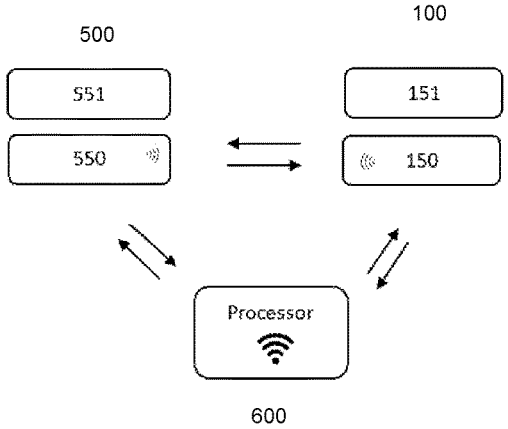
FIG. 11 shows a diagrammatic view of communication between sensors and the processor of the system.

FIG. 11 shows a diagrammatic example of a preferred example of the system having a base 100, an exercise device 500 and an electronic device 600 that includes the processor. The base 100 has a sensor 150 and the exercise device 500 has a sensor 550. Both sensors 150, 550 communicate to detect if the exercise device 500 is connected to the base 100.

Sensor 150 is configured to detect presence of the exercise device 500 and determine the type of exercise device upon receipt of one or more signals from the exercise device sensor 550. In this example the exercise device sensor 550 transmits a signal to the base sensor 150 that confirms presence and type of exercise device. In this example one sensor transmits a signal and the other sensor receives the signal and therefore both sensors do not transmit and receive. It is appreciated that a signal to identify the exercise device may also confirm receipt of the exercise device onto the base. For example the base sensor 150 may receive a signal from the exercise device sensor 550 that confirms presence and data, such as a code, relating to the type of exercise device. A signal is then transmitted from the base sensor 150 to the processor on the electronic device 600 where the signal can be analysed and corresponding events may occur, such as provision of a resistance force map training program.

At least one of sensor 150 or 151 operative to communicate with the processor when the resistance apparatus is engaged with a drive mechanism on the interchangeable exercise device.

For example when presence of the exercise device and type of exercise device is detected by sensor 150 a signal may be transmitted to the processor.

It is appreciated that the base 100 may have one sensor 150 that has multiple sensing means so that one sensor could be capable of detect presence of an exercise device, identifying the exercise device and sense data relating to resistance applied by the resistance apparatus.

For the purposes of the example shown in FIG. 11, sensor 151 is arranged on the resistance apparatus (not shown in FIG. 11) of the base 100 to communicate with the processor when the resistance apparatus is engaged with the drive mechanism on the exercise device. Sensor 151 senses data relating to resistance.

Sensor 551 is in communication with the drive apparatus (not shown) on the exercise device 500 and detects parameters relating to drive, such as revolutions per minute/force applied. Sensor 551 is an example of an additional sensor that may communicate with the processor to provide further information that can be used to provide more exercise related data for a user and may also assist with recorded hours of use of the exercise device that may be useful when considering maintenance of the exercise device.

The processor is able to receive and transmit signals, indicated by arrows showing two way communication with the sensors 150, 151, 550, 551.

It is appreciated that a sensor may only transmit a signal, may only receive a signal, or may both transmit and receive a signal.

Signals transmitted from a sensor to the processor are analysed and under certain conditions the processor will generate command signals to be sent from the processor to the resistance apparatus to alter resistance. Signals transmitted from a sensor to the processor are also analysed to provide information for a user relating to exercised perform and this information may be stored and/or displayed on the electronic device.

A preferred embodiment of the system comprises any one of the pictured or described bases 100, 200, 300, 400, with at least one sensor as described above, an exercise device 500 mounted thereupon with at least one sensor as described above and an electronic device 600 that houses a processor, a transmitter, a receiver and the control means.

The invention has been described by way of examples only and it will be appreciated that variation may be made to the above-mentioned embodiments without departing from the scope of invention as defined by the claims.

The invention claimed is:

1. A base for a modular exercise system comprises: a ground element for locating the base on a surface; a resistance apparatus mounted on the ground element; an attachment means for receiving and connecting an interchangeable exercise device to the base; and at least one sensor which is operative to detect and identify the interchangeable exercise device when connected to the base and is operative to communicate with a processor when the resistance apparatus is engaged with a drive mechanism on the interchangeable exercise device.

2. A base according to claim 1 wherein the at least one sensor or a second sensor is operative to transmit a signal to a receiver in communication with the processor confirming when the resistance apparatus is being driven by the drive mechanism on the interchangeable exercise device.

3. A base according to claim 1 wherein the processor is provided as part of an electronic device that has a transmitter, a receiver and a display.

4. A base according to claim 1 wherein the interchangeable exercise device includes a control means which communicates with the resistance apparatus and enables a user to vary a force applied by the resistance apparatus.

5. A base according to claim 4 wherein the processor is operatively connected with the control means.

6. A base according to claim 1 includes at least one second sensor which senses a force applied through the drive mechanism; and the processor derives a signal indicative of an amount of work done by a user.

7. A base according to claim 1 wherein a transmitter is provided on the base which is operative to transmit a signal to a receiver in communication with the processor indicative of at least one of: a force applied by a user; a level of resistance provided by the resistance device; an exercise start time; an exercise end time and total energy expended (kJ or kcal).

8. A base according to claim 1 wherein the resistance apparatus has an adjustment means for varying its resistance.

9. A base according to claim 1 wherein the attachment means includes a bracket for receiving the interchangeable exercise device.

10. A base according to claim 9 wherein the bracket includes a first finger with a tube that receives a pin and a second finger for receiving the exercise device and a distal end of the pin.

11. A base according to claim 10 wherein the first finger is adapted to support a first hub of the resistance apparatus.

12. A base according to claim 11 including a dog clutch for engaging a first engagement surface on the first hub of the resistance apparatus, with a second engagement surface on a second hub on the interchangeable exercise device.

13. A base according to claim 12 including a switch to engage and disengage the first and second engagement surfaces of the dog clutch.

14. A base according to claim 11 including a one-way freewheel clutch for engaging the first hub of the resistance apparatus with the second hub of the interchangeable exercise device.

15. A base according to claim 11 including a pin with at least one spline that engages with the first hub of the resistance apparatus and a second hub on the exercise device by means of at least part of inner faces of the first and second hubs which each have a toothed profiles so that the first and second hubs rotate in unison when engaged with the spline of the pin.

16. A base according to claim 15 wherein a distal end of each spline on the pin is angled for engagement with the first and second hubs.

17. A base according to claim 1 wherein the attachment means is connected to the resistance apparatus.

18. A base according to claim 1 wherein the resistance apparatus has a connector for receiving a driveshaft that is connected to the drive mechanism of the interchangeable exercise device.

19. A base according to claim 1 wherein the ground element is adjustable in height/orientation.

20. A system comprising the base according to claim 1, an exercise device mounted thereupon with at least one sensor, and an electronic device that houses a processor, a transmitter, a receiver and a control means.

21. An interchangeable exercise device for use with the base according to claim 1.

* * * * *